US009085394B2

(12) United States Patent
Hall

(10) Patent No.: US 9,085,394 B2
(45) Date of Patent: Jul. 21, 2015

(54) ELASTIC DRAWSTRING FOR TRASH BAGS

(71) Applicant: George M. Hall, Colleyville, TX (US)

(72) Inventor: George M. Hall, Colleyville, TX (US)

(73) Assignee: Poly-America, L.P., Grand Prairie, TX (US)

( * ) Notice: Subject to any disclaimer, the term of this patent is extended or adjusted under 35 U.S.C. 154(b) by 0 days.

(21) Appl. No.: 14/504,918

(22) Filed: Oct. 2, 2014

(65) Prior Publication Data

US 2015/0023616 A1 Jan. 22, 2015

Related U.S. Application Data

(63) Continuation of application No. 12/552,922, filed on Sep. 2, 2009, now Pat. No. 8,877,307.

(51) Int. Cl.

| | |
|---|---|
| ***B65D 33/28*** | (2006.01) |
| ***B65D 33/16*** | (2006.01) |
| ***B65F 1/00*** | (2006.01) |

(52) U.S. Cl.

CPC ..... *B65D 33/28* (2013.01); *B65F 1/0006* (2013.01); *Y10T 428/1334* (2015.01); *Y10T 428/1352* (2015.01); *Y10T 428/1397* (2015.01)

(58) Field of Classification Search

CPC ..... B65D 33/28; C08L 23/06; C08L 2205/02; C08L 2666/06; B32B 27/32

USPC ..... 428/34.1, 35.7

See application file for complete search history.

(56) References Cited

U.S. PATENT DOCUMENTS

| | | | | |
|---|---|---|---|---|
| 2005/0063622 | A1* | 3/2005 | Kannabiran | 383/75 |
| 2010/0172602 | A1* | 7/2010 | O'Donnell et al. | 383/75 |

* cited by examiner

*Primary Examiner* — Ellen S Wood

(74) *Attorney, Agent, or Firm* — Brandon J. Lee; Daniel J. Layden

(57) ABSTRACT

The present invention is directed toward an improved elastic drawstring for use with a trash bag. The elastic drawstring is comprised primarily of a two-component polyethylene blend. The first polyethylene component is a linear low-density polyethylene (LLDPE) having a density of 0.915 g/cc or less, with a preferred range of between 0.900 g/cc and 0.915 g/cc. In certain preferred embodiments, the density of the first polyethylene component is approximately 0.906 g/cc. The second polyethylene component is a low-density polyethylene (LDPE) having a density of between 0.915 g/cc and 0.929 g/cc. In a preferred embodiment, the second polyethylene component has a density of approximately 0.918 g/cc.

21 Claims, 2 Drawing Sheets

ELASTIC DRAWSTRING FOR TRASH BAGS

CROSS-REFERENCE TO RELATED APPLICATIONS

Figure 1:
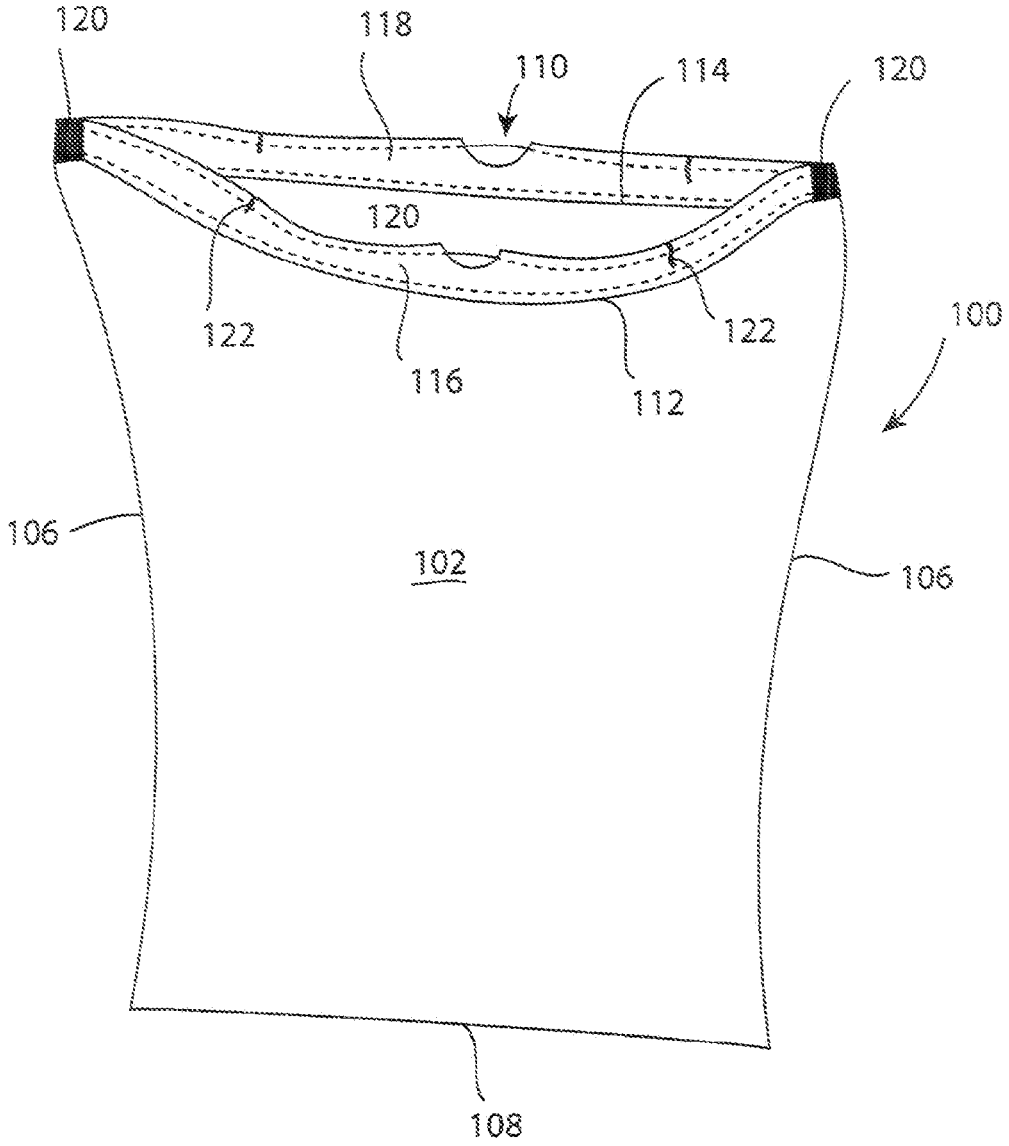

This application is a continuation of application Ser. No. 12/552,922, filed Sep. 2, 2009, and is hereby incorporated by reference into this disclosure.

BACKGROUND OF THE INVENTION

1. Field of the Invention

The present invention relates to improvements in the construction and manufacture of polymeric bags. In particular, the present invention relates to improvements in the construction and manufacture of elastic drawstrings for use with polymeric bags.

2. Description of the Related Art

Polymeric bags are ubiquitous in modern society. Polymeric bags are available in different combinations of material, capacity, thickness, dimensions and color. In terms of potential applications, polymeric bags may be used for product packaging, long-term storage of goods, food storage, and trash collection, among other uses. In response to consumer demand, manufacturers of polymeric bags have developed innovative, new technology over the years to improve the utility and performance of polymeric bags. The present invention described herein is one such improvement and is of particular relevance to drawstring trash bags.

Drawstring trash bags are a popular alternative to the standard twist-tie or flapped trash bags. As the name suggests, drawstring bags incorporate drawstrings, also known as drawtape, into the bag design. In a typical drawstring trash bag known in the prior art, a pair of drawstrings are enclosed within hems running along the opening of the trash bag. The drawstrings are allowed to slide freely within the hems and are physically joined to the bag by a pair of short seals formed by applying a combination of heat and pressure, welding the drawstrings to the panels of the bag. The short seals serve to hold the respective ends of the drawstrings in place, allowing a user to pull the drawstrings through the opening cut outs of the respective hems. The drawstrings can then be tied to securely close the bag and provide a convenient handle for carrying the bag.

Despite the popularity of drawstring bags, traditional drawstring bags do suffer from some disadvantages. In particular, many consumers find that drawstring bags are difficult to secure over the upper lip of a trash receptacle. For example, when the traditional drawstring trash bag is pulled over the upper lip of the receptacle, the bag does not offer any means to secure the bag to the outside of the receptacle. Therefore, when trash is placed in the receptacle, the force on the bag as the trash is thrown into the receptacle and the total weight of the trash has a tendency to pull the sides of the bag down into the trash can. It would be desirable to offer an alternative to traditional drawstring trash bags known in the art so as to provide a means for securing the bag over the upper lip of the trash receptacle.

In the prior art, it was disclosed to utilize elastomeric materials as components of the drawstrings for a trash bag to provide a way to secure the bag over the upper lip of a trash receptacle. In particular, certain prior art applications disclose an elastic drawstring trash bag with a pair of large notches at the upper corners of the bag to allow the ends of the drawstrings to be pulled through the hems along the upper corners of the bag. However, the drawstrings for these types of applications are known to be markedly thicker than ordinary drawstrings, requiring significantly more material, which, in turn, considerably increases the costs. It would be desirable to provide an elastic drawstring for trash bags that is more cost-effective.

Ultimately, the design of a quality elastic drawstring must provide a balance between minimizing the cost of the materials, retaining a sufficiently high tensile strength, and providing an elastic drawstring with suitable recovery. To minimize the cost, it would be desirable to reduce the thickness of the elastic drawstring. Similarly, utilizing traditional polyethylene rather than specialty elastomeric materials, can also reduce the cost of the elastic drawstring. High tensile strength should be balanced with a high recovery. Ideally, the drawstring would expand with a relatively high recovery but still offer a high tensile strength to prevent the drawstring from yielding when pulled to close the bag and for carrying. The present invention is intended to address these issues and desires.

SUMMARY OF THE INVENTION

The present invention is directed toward an improved elastic drawstring for use with a trash bag. The elastic drawstring is comprised primarily of a two-component polyethylene blend. The first polyethylene component is a linear low-density polyethylene (LLDPE) having a density of 0.915 g/cc or less, with a preferred range of between 0.900 g/cc and 0.915 g/cc. In certain preferred embodiments, the density of the first polyethylene component is approximately 0.906 g/cc. The second polyethylene component is a low-density polyethylene (LDPE) having a density of between 0.915 g/cc and 0.930 g/cc. In a preferred embodiment, the second polyethylene component has a density of approximately 0.918 g/cc.

The two-component polyethylene blend comprises at least 85%, by weight, and preferably 93%, by weight, of the elastic drawstring. Furthermore, the ratio of the first polyethylene component to the second polyethylene component is preferably between 4:1 and 2:1 with a preferred ratio of 3:1.

It is contemplated that the present invention may be utilized in ways that are not fully described or set forth herein. The present invention is intended to encompass these additional uses to the extent such uses are not contradicted by the appended claims. Therefore, the present invention should be given the broadest reasonable interpretation in view of the present disclosure, the accompanying figures, and the appended claims.

BRIEF DESCRIPTION OF THE RELATED DRAWINGS

A full and complete understanding of the present invention may be obtained by reference to the detailed description of the present invention and preferred embodiment when viewed with reference to the accompanying drawings. The drawings can be briefly described as follows.

FIG. 1 provides a perspective view of the elastic drawstring trash bag as contemplated by the present invention.

Figure 2:
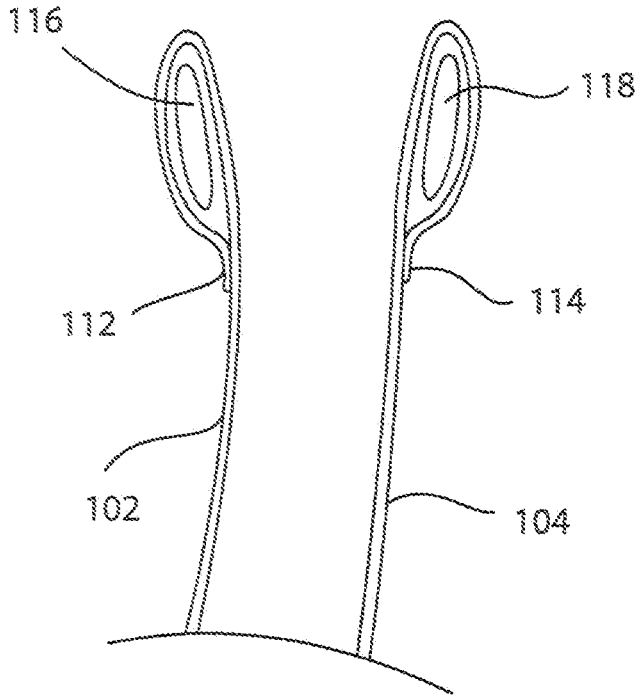

FIG. 2 provides an elevation view of a cross-section of a trash bag, which incorporates the elastic drawstring of the present invention.

DETAILED DESCRIPTION OF THE INVENTION

The present disclosure illustrates one or more preferred embodiments of the present invention. It is not intended to provide an illustration or encompass all embodiments contemplated by the present invention. In view of the disclosure of the present invention contained herein, a person having ordinary skill in the art will recognize that innumerable modifications and insubstantial changes may be incorporated or otherwise included within the present invention without diverging from the spirit of the invention. Therefore, it is understood that the present invention is not limited to those embodiments disclosed herein. The appended claims are intended to more fully and accurately encompass the invention to the fullest extent possible, but it is fully appreciated that certain limitations on the use of particular terms is not intended to conclusively limit the scope of protection.

Referring to FIG. 1, a perspective view of an elastic drawstring bag 100 is depicted to illustrate an embodiment of the present invention. In the depicted embodiment, the elastic drawstring bag 100 is manufactured from a first panel 102 and a second panel 104. Typically, the elastic drawstring bags 100 will be manufactured with a blown-film extrusion process. In the blown-film extrusion process, polyethylene is extruded through a die, which is expanded by using forced air to create a polyethylene tube. After the polyethylene tube is cooled, it can be flattened, forming the first panel 102 and the second panel 104 of the elastic drawstring bag 100. The folded portion of the flattened, polyethylene tube forms the bag bottom 108 and transverse cuts and seals are provided across the width of the flattened, polyethylene tube to form the bag sides 106. While this construction method is the preferred method for manufacture, the invention disclosed herein is not necessarily limited to any particular manufacturing method or construction.

After manufacture of the body of the elastic drawstring bag 100, it then becomes necessary to provide drawstrings 116 and 118 within hems 112 and 114 formed around the drawstrings. To provide this, an upper edge of the first panel 102 is folded over and sealed to form the first hem 112. Similarly, an upper edge of the second panel 104 is folded over and sealed to form the second hem 114. A first elastic drawstring 116 is disposed within the first hem 112 and runs across the width of the first panel 102 while a second elastic drawstring 118 is provided within the second hem 114 and runs across the width of the second panel 104. The first elastic drawstring 116 and the second elastic drawstring 118 are both preferably provided in a relaxed or substantially relaxed state.

In a preferred embodiment, the respective ends of the first elastic drawstring 116 and the second elastic drawstring 118 are secured within the hems 112 and 114 by a pair of short seals 120 provided in the upper corners of the elastic drawstring trash bag. Additionally, some embodiments, including the depicted preferred embodiment of the present invention, contemplate an elastic drawstring bag 100 that includes central access cutouts 110 similar to those in conventional drawstrings bags. The central access cutouts 110 make the bag more familiar to a consumer, and the consumer can pull the elastic drawstrings 116 and 118 through the cutouts 110 to close the opening of the bag.

Some embodiments of the present invention are also provided with a plurality of air ventilation slits/holes 122 to allow air built-up in the hem to escape during the manufacturing process. Without such air ventilation slits/holes 122, the hems could have a tendency to "bubble." As an additional advantage, the air ventilation holes 122 also permit the polyethylene material encompassing the elastic drawstring to stretch and deform to a slightly greater degree. While the depicted configuration is preferred, it is contemplated that the present invention could be utilized in numerous other drawstring bag configurations.

FIG. 2, which is not to scale, depicts elastic drawstrings 116 and 118 disposed within hems formed in the elastic drawstring trash bag 100. To provide the hems for containing the elastic drawstrings 116 and 118, the uppermost portion of the first and second panels 102 and 104 are folded over the elastic drawstrings 116 and 118, respectively. The first hem 112 is created after forming a hem seal on the first panel 102 while the second hem 114 is sealed by the hem seal on the second panel 104, encapsulating the elastic drawstrings 116 and 118 within the respective hems 112 and 114. The hem seals may generally be formed by applying a combination of heat and pressure to each panel, sealing the two layers of polyethylene film together.

The elastic drawstrings 116 and 118 are primarily comprised of a two-component polyethylene blend. The first polyethylene component is a linear low-density polyethylene (LLDPE) having a density of 0.915 g/cc or less. In some embodiments, the first polyethylene component has a density of greater than 0.885 g/cc. It is preferred that the density of the first polyethylene component be between 0.900 g/cc and 0.915 g/cc with a preferred density of approximately 0.906 g/cc. Additionally, the first polyethylene would preferably have a melt index of less than 1 with a preferred melt index of approximately 0.5.

The second polyethylene component of the polyethylene blend is a low-density polyethylene (LDPE). In certain preferred embodiments, the second polyethylene component has a density of 0.915 g/cc or greater. In certain embodiments of the present invention, the second polyethylene component will be selected to have a density of between 0.915 g/cc and 0.929 g/cc, with a preferred density of 0.918 g/cc. Additionally, in some embodiments of the present invention, the second polyethylene component will have a melt index of less than 0.5 with a preferred melt index of 0.25.

The two-component polyethylene blend constitutes the substantive ingredient of the elastic drawstrings 116 and 118. In certain embodiments of the present invention, the ratio of the first polyethylene component to the second polyethylene component in the polyethylene blend may range from approximately 1:1 to 4:1. However, subjective and objective testing has shown that the ratio of the first and second polyethylene components in certain applications is preferred to be approximately 3:1.

The two-component polyethylene blend will typically comprise at least 85 percent of the elastic drawstring by weight and is preferably approximately 93 percent of the drawstring by weight. The remaining portion of the elastic drawstring may be comprised of various additives, such as pigments, anti-blocking agents, and slip agents, which reduce the coefficient of friction on the surface of the elastic drawstring 116 and 118, which facilitates the free movement of the elastic drawstrings within the hems 112 and 114. The various additives contemplated by the present invention are well-known in the prior art to improve performance or provide certain qualities when used with both elastic and non-elastic drawstrings. It is also contemplated that the first polyethylene component and the second polyethylene component may already include a limited amount of pigment and/or various additives, which may be beneficial in blown-film extrusion, casting, or any other suitable method of manufacture.

Another aspect of the present invention is the elimination, or reduction, of any additional components such as polypropylene or ethylene-vinyl acetate (EVA). The present invention functions satisfactorily without the inclusion of any significant amounts of either polypropylene or ethylene-vinyl acetate. In fact, it would be desirable, in certain embodiments, to limit the amount of polypropylene to less than five percent by weight. Similarly, it is desirable to limit the amount of ethylene-vinyl acetate to less than five percent by weight. In fact, in the preferred embodiments of the present invention, the elastic drawstring does not contain any polypropylene nor does the elastic drawstring contain any ethylene-vinyl acetate.

In assessing the value of the present invention, a combination of objective and subjective testing has shown the thickness of the elastic drawstrings 116 and 118 can be reduced significantly with good results when compared to prior art elastic drawstrings. While the preferred thickness of the elastic drawstrings 116 and 118 disclosed by present invention are expected to be approximately 4.5 mils, or 0.0045 inches, it is contemplated that any thickness of between 3 mils and 6 mils may provide good results depending upon the application. The thickness of the elastic drawstrings 116 and 118 in the present invention is therefore significantly less than the 7 mil (0.007 inches) elastic drawstrings disclosed in the prior art.

As noted, the embodiments depicted herein are not intended to limit the scope of the present invention. Indeed, it is contemplated that any number of different embodiments may be utilized without diverging from the spirit of the invention. Therefore, the appended claims are intended to more fully encompass the scope of the present invention.

I claim:

1. An elastic drawstring bag comprising:

a bag comprising a first panel and a second panel, the first panel and the second panel joined along a first side, a bottom, and a second side, the first panel and the second panel defining an upper opening of the bag, a first hem located along the upper opening of the bag, a first elastic drawstring disposed within the first hem, the first elastic drawstring comprising a blend of at least 50% LLDPE of a total weight of the first elastic drawstring and at least 20% LDPE of the total weight of the first elastic drawstring, and the LLDPE having a density of 0.915 g/cc or less.

2. The elastic drawstring bag of claim 1, further comprising the polyethylene blend comprising at least 85%, by weight, of the first elastic drawstring.

3. The elastic drawstring bag of claim 2, further comprising the polyethylene blend comprising approximately 93%, by weight, of the first elastic drawstring.

4. The elastic drawstring bag of claim 1, wherein the density of the linear low-density polyethylene is greater than 0.885 g/cc.

5. The elastic drawstring bag of claim 4, wherein the density of the linear low-density polyethylene is between 0.900 g/cc and 0.915 g/cc.

6. The elastic drawstring bag of claim 5, wherein the density of the linear low-density polyethylene is approximately 0.906 g/cc.

7. The elastic drawstring bag of claim 1, wherein the linear low-density polyethylene has a melt index of less than 1.

8. The elastic drawstring bag of claim 7, wherein the melt index of the linear low-density polyethylene is approximately 0.5.

9. The elastic drawstring bag of claim 1, wherein the density of the low-density polyethylene is between 0.915 g/cc and 0.929 g/cc.

10. The elastic drawstring bag of claim 9, wherein the density of the low-density polyethylene is approximately 0.918 g/cc.

11. The elastic drawstring bag of claim 1, wherein the low-density polyethylene has a melt index of less than 0.5.

12. The elastic drawstring bag of claim 11, wherein the melt index of the low-density polyethylene is approximately 0.25.

13. The elastic drawstring bag of claim 1, wherein the ratio of the polyethylene blend is approximately 3:1.

14. The elastic drawstring bag of claim 1, further comprising:

the elastic drawstring containing less than 5%, by weight, of polypropylene.

15. The elastic drawstring bag of claim 14, wherein the elastic drawstring contains no polypropylene.

16. The elastic drawstring bag of claim 1, further comprising:

the elastic drawstring containing less than 5%, by weight, of ethylene-vinyl acetate.

17. The elastic drawstring bag of claim 16, wherein the elastic drawstring contains no ethylene-vinyl acetate.

18. The elastic drawstring bag of claim 1, further comprising:

the elastic drawstring having a thickness between 3 mils and 6 mils.

19. The elastic drawstring bag of claim 1, further comprising:

the low-density polyethylene with a density of 0.915 g/cc or greater.

20. An elastic drawstring bag comprising:

a bag comprising a first panel and a second panel, the first panel and the second panel joined along a first side, a bottom, and a second side, the first panel and the second panel thereby defining an upper opening of the bag, a first hem located along the upper opening of the bag, a first elastic drawstring disposed within the first hem, the first elastic drawstring having at least one layer comprising a blend of at least 50 percent LLDPE of a total weight of the drawstring and at least 20 percent LDPE of the total weight of the drawstring.

21. An elastic drawstring bag comprising:

a bag comprising a first panel and a second panel, the first panel and the second panel joined along a first side, a bottom, and a second side, the first panel and the second panel defining an upper opening of the bag, a first hem located along the upper opening of the bag, a first elastic drawstring disposed within the first hem, and the first elastic drawstring having at least one layer comprising a blend of an LLDPE and LDPE, and the LLDPE of the first layer comprising at least 50 percent of a total weight of the drawstring and the LDPE of the first layer comprising at least 20 percent of the total weight of the drawstring.

* * * * *